US005927671A

United States Patent [19]

Pynenburg

[11] Patent Number: 5,927,671

[45] **Date of Patent: *Jul. 27, 1999**

[54] SNAP CLOSING PANEL HOLDER

[75] Inventor: Adrian Pynenburg, Brantford, Canada

[73] Assignee: Storeimage Programs Inc., Brantford, Canada

[ * ] Notice: This patent is subject to a terminal disclaimer.

[21] Appl. No.: 08/757,437

[22] Filed: Nov. 27, 1996

Related U.S. Application Data

[63] Continuation of application No. 08/332,124, Oct. 31, 1994, Pat. No. 5,584,461, which is a continuation-in-part of application No. 07/830,890, Feb. 4, 1992, Pat. No. 5,364,057.

[51] Int. Cl.[6] ..... G09F 3/20

[52] U.S. Cl. ..... 248/451; 24/67.3; 24/498; 40/647; 248/475.1

[58] Field of Search ..... 248/451, 452, 248/466, 468, 475.1; 24/498, 499, 518, 67.3, 67 R; 40/658, 156, 647

[56] References Cited

U.S. PATENT DOCUMENTS

| | | | |
|---|---|---|---|
| 2,330,777 | 9/1943 | Elliot | 248/451 |
| 2,882,633 | 4/1959 | Howell . | |
| 2,941,324 | 6/1960 | Waxgiser . | |
| 2,979,842 | 4/1961 | De Ridder . | |
| 3,249,351 | 5/1966 | Smith . | |
| 3,643,362 | 2/1972 | Hackett . | |
| 3,914,892 | 10/1975 | Mohr . | |
| 4,105,127 | 8/1978 | Holl . | |
| 4,237,632 | 12/1980 | Segerstad . | |
| 4,498,255 | 2/1985 | Heard . | |
| 4,523,400 | 6/1985 | Seely . | |
| 4,702,025 | 10/1987 | Mace . | |
| 4,703,575 | 11/1987 | Diamond . | |
| 4,835,891 | 6/1989 | Joffe . | |
| 4,864,699 | 9/1989 | Whitcomb . | |
| 4,884,351 | 12/1989 | Abramson . | |
| 5,152,490 | 10/1992 | Deutsch . | |
| 5,381,991 | 1/1995 | Stocker . | |
| 5,384,935 | 1/1995 | Maier-Hunke . | |

FOREIGN PATENT DOCUMENTS

| | | |
|---|---|---|
| 1 021 565 | 11/1977 | Canada . |
| 1 041 762 | 11/1978 | Canada . |
| 1 070 945 | 2/1980 | Canada . |
| 1 097 068 | 3/1981 | Canada . |
| 1 236 692 | 5/1988 | Canada . |
| 1 364 606 | 3/1963 | France . |

OTHER PUBLICATIONS

Expovision, Inc., Twinshap Brochure, at least as early as 1988.

*Primary Examiner*—Derek J. Berger
*Attorney, Agent, or Firm*—Baker & Daniels

[57] ABSTRACT

A panel holder is disclosed for hanging posters and other sheet material and which can be either wall mounted or suspended from a ceiling. The holder includes two longitudinal extruded panels each having a longitudinal C-shaped flange situated along one of the panel edges. One flange is inserted within the other one to form a longitudinal interlocking hinge connection. The panels are movable with respect to each other in a transverse direction about this hinge coupling between an open and a closed position. The flanges are dimensioned in such a way that rotation of the panels with respect to one another in the transverse direction results in one of the flanges being elastically deformed during the first part of the motion, with the resulting stored elastic energy being abruptly released during the second part of the panel motion, thereby giving rise to the holder snapping open or closed. At least one of the panels has at least one longitudinal rib member formed thereon and located near a peripheral edge spaced from the C-flange. Each rib member in located on a side of the panel facing a planar portion of the other panel when the panels are in the closed position. Each rib member is made of a softer, more resilient material than the rest of the panel.

14 Claims, 6 Drawing Sheets

SNAP CLOSING PANEL HOLDER

This is a continuation of application Ser. No. 08/332,124 filed Oct. 31, 1994 U.S.Pat. No. 5,584,461 which is a continuation-in-part of application Ser. No. 07/830,890 filed Feb. 4, 1992 U.S.Pat. No. 5,364,057.

FIELD OF THE INVENTION

The present invention relates to an improved poster holder for mounting or hanging posters or other sheet material.

BACKGROUND OF INVENTION

There are several types of frames or holders in use which employ two panels adapted to fit around the borders of a poster or other article to be displayed. The panels are hinged together along one peripheral edge while compressing the poster between the opposite peripheral edge. One approach is to hinge the panels together through a third hinged connector such as in U.S. Pat. No. 4,703,575, or alternatively the panels can be hinged together using a pivot pintle assembly as disclosed in Canadian Patent No. 1,236,692 and Patent No. 1,097,068. One drawback of these configurations is that they are difficult to adapt to hanging poster applications where the peripheral hinged edges would interfere with attempts to hang the holders, this is because the panels would not be able to swing to their fully open position.

Other designs employ panels with fixed slots designed to receive and hold the poster, such as is disclosed in Canadian Patent No. 1,041,762. A drawback to such designs is that they require special coupling techniques at the corners which reduces their versatility. Those poster hangers employing metal components are also less versatile than poster hangers made of all plastic due to increased production costs, increased weight and the need for special tools to cut the holders to non-standard sizes. Many types of poster holders also employ a distinct structural member for biasing the panels in the open or closed position which can also reduce the versatility of the holder.

SUMMARY OF THE INVENTION

In the present invention, a panel holder has two longitudinal panels each having a longitudinal C-shaped flange situated along a peripheral edge of the panel. One of the flanges is slidingly received by the other to form a longitudinal hinge coupling. The panels are movable with respect to each other in a transverse direction and the flanges are flexible and dimensioned so that the panels snap between an open and closed position.

According to one aspect of the invention there is provided a panel holder comprising a first longitudinal panel having a first planar portion and a first longitudinal, C-shaped flange attached to and running along a first peripheral edge thereof. The C-shaped flange includes an outer wall and an inturned tongue attached to the outer wall which is disposed toward and is spaced from the first planar portion. The outer wall is spaced from the first planar portion a first determined distance. A second longitudinal panel having a second planar portion is provided which has a second longitudinal C-shaped flange attached to and running along a first peripheral edge thereof and wherein the second C-shaped flange includes an inner wall portion having an outer surface, an upper wall attached to the inner wall portion and a peripheral lip attached to the upper wall. The outer extremity of the peripheral lip is spaced from the outer surface a second predetermined distance and the peripheral lip extends transversely from the inner wall portion a third predetermined distance.

The second flange is slidingly received within the first flange and the first predetermined distance is slightly smaller than the second predetermined distance but greater than the third predetermined distance. One of the flanges is resilient such that transverse rotation of one panel with respect to the other panel causes the panels to snap between an open and a closed position.

According to another broad aspect of the invention there is provided a panel holder comprising a first longitudinal panel having a first planar portion and a first longitudinal, C-shaped flange located along a first peripheral edge thereof. The C-shaped flange includes an outer wall and an inturned tongue attached to the outer wall which is disposed toward and is spaced from the first planar portion. The outer wall is spaced from the first planar portion a first predetermined distance. A second longitudinal panel having a second planar portion is provided which has a second longitudinal C-shaped flange located along a first peripheral edge thereof and wherein the second C-shaped flange includes an inner wall portion having an outer surface, an upper wall attached to the inner wall portion and a peripheral lip attached to the upper wall. The outer extremity of the peripheral lip is spaced from the outer surface a second predetermined distance and the peripheral lip extends transversely from the inner wall portion a third predetermined distance.

The second flange is slidingly received within the first flange and the first predetermined distance is slightly smaller than the second predetermined distance but greater than the third predetermined distance. One of the flanges is resilient such that transverse rotation of one panel with respect to the other panel causes the panels to snap between an open and a closed position. The first predetermined distance is greater than the third predetermined distance by a sufficient amount such that in the open position a gap is formed between the first planar portion and the upper wall of the second C-shaped flange for receiving a panel therebetween.

According to another aspect of the invention, there is provided a panel holder comprising a first longitudinal panel provided with a first planar portion and a first longitudinal, C-shaped flange located along a first peripheral edge thereof. The C-shaped flange includes an outer wall and an inturned tongue attached to the outer wall which is disposed toward and spaced from the first planar portion. The outer wall is spaced from the first planar portion a first predetermined distance. A second longitudinal panel is provided having a second planar portion and a second longitudinal C-shaped flange located along a first peripheral edge thereof. The second C-shaped flange includes an inner wall portion having an outer surface, an upper wall attached to the inner wall portion and a peripheral lip attached to the upper wall. The outer extremity of the peripheral lip is spaced from the outer surface a second predetermined distance and the peripheral lip extends transversely from the inner wall portion a third predetermined distance. The second panel is provided with at least one resilient, inwardly disposed longitudinal rib extending along a second peripheral edge thereof. A third longitudinal panel is attached to the first panel along the first peripheral edge but located on the opposite side of the panel to the C-shaped flange. The third panel has a second peripheral edge spaced from the first peripheral edge, the third panel being spaced from the first planar portion of the first panel. The second longitudinal peripheral edges of the first and third panels are spaced apart to form a receiving mouth for a poster holder supporting means. The second flange is slidably received within the first flange. The first predetermined distance is slightly smaller than the second predetermined distance and the third predetermined distance is less than the first predetermined distance. One of the flanges is resilient such that transverse rotation at one panel with respect to the other panel causes the panels to snap between an open and closed position. Also, the first predetermined distance is greater than the third predetermined distance by a sufficient amount such that in the open position a gap is formed between the first planar portion and the second panel upper wall for receiving a poster therebetween.

The first and second panels are provided with resilient co-extruded and inwardly extending longitudinal ribs, spaced from the first peripheral edges of each panel. When the panels are in the closed position the ribs are in registration and engaged for gripping a panel therebetween.

In yet another aspect of the invention there is provided a first longitudinal panel which has a first planar portion and a T-shaped member, which includes first and second longitudinal C-shaped flange portions. Each of the C-shaped flange portions has an outer wall and an inturned tongue attached to the outer wall and disposed toward and spaced from the planar portion. Each outer wall is spaced from the first planar portion a first predetermined distance.

A second longitudinal panel is also provided which includes a second planar portion and a longitudinal C-shaped flange. The C-shaped flange is attached to and runs along a first peripheral edge of the second panel. The C-shaped flange includes an inner wall portion having an outer surface, an upper wall portion attached to the inner wall portion and a peripheral lip attached to the upper wall. The outer extremity of the peripheral lip is spaced from the outer surface a second predetermined distance. The peripheral lip extends from the upper wall portion a third predetermined distance.

The C-shaped flange is slidably received within one of the C-shaped portions of the T-shaped member. The first predetermined distance is slightly smaller than the second predetermined distance. The third predetermined distance is less than the first predetermined distance. Either the flange or one of the C-shaped portions is resilient so that transverse rotation of one panel with respect to the other panel causes the panels to snap between an open and closed position.

According to a further aspect of the invention, a panel holder comprises a first elongate panel provided with a first planar portion and a longitudinal generally C-shaped flange located along a first peripheral edge thereof; a second elongate panel having a main portion with at least one longitudinal rib member formed thereon and located near a peripheral edge of said second panel spaced from said C-shaped flange, said at least one rib member being located on a side of said second panel facing said first planar portion when said second panel is in a closed, panel-gripping position and being made of a softer, more resilient material than the rest of the second panel; means for pivotably connecting said second elongate panel to said C-shaped flange so that said second panel can be pivoted from said closed position to an open position; and means for releasably holding said second panel in said closed position.

According to a still further aspect of the invention, a panel holder comprises an elongate first member provided with a first panel having an inwardly projecting longitudinal rib with a transverse planar portion, a first longitudinal, generally C-shaped flange located along a first peripheral edge thereof and having an inturned tongue extending towards and spaced from said rib planar portion; an elongate second panel provided with a second panel portion and a second longitudinal C-shaped flange located along a first peripheral edge thereof, the second flange being slidably received within the first flange and said second panel being pivotable relative to said first member between an open position and a closed, panel-gripping position; and at least one soft, co-extruded longitudinal rib formed on at least one of said first and second panels and located along a peripheral edge thereof spaced from said C-shaped flanges, said at least one rib member being located on a side of its respective panel facing the other of said panels in the closed position of the second panel and being made of a softer, more resilient material than its respective panel.

According to yet another aspect of the invention, a panel holder comprises a first elongate member having a first elongate panel portion with first and second longitudinal peripheral edges, a second elongate member having a second panel portion and pivotable with respect to said first member, means for pivotably connecting said second member to said first member along said first peripheral edge so that the two elongate members can pivot between an open position and a closed, panel-gripping position, and at least one soft co-extruded longitudinal rib formed on said second panel portion and located adjacent a peripheral edge thereof spaced from said first peripheral edge, said at least one rib being located on a side of said second panel portion facing said first panel portion in said closed position and being made of a softer, more resilient material than the second elongate member.

BRIEF DESCRIPTION OF THE DRAWINGS

Preferred embodiments of the invention will now be described by way of example with reference to the accompanying drawings, in which:

FIG. 11*a* is a plan view of an alternative embodiment of a cylindrical hanger unit for use with the embodiment of a panel holder depicted in FIG. 9*a.

DETAILED DESCRIPTION OF THE PREFERRED EMBODIMENTS

Figure 1:
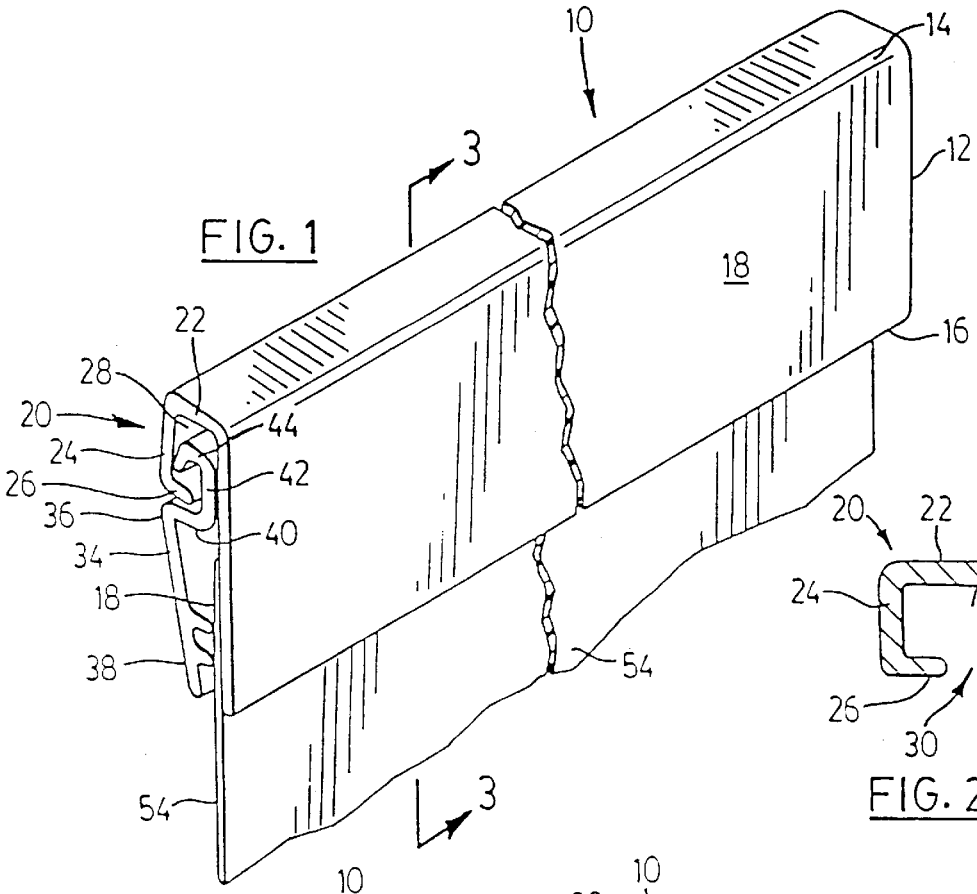
FIG. 1 is a perspective view of a preferred embodiment of a panel holder according to the present invention as shown in the closed position.
Figure 2:
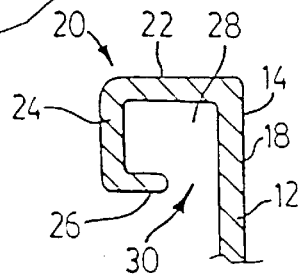
FIG. 2 is a cross sectional view of a C-shaped flange portion of the first panel of the preferred embodiment shown in FIG. 1.

Referring to FIGS. 1, 2 and 3*a*–3*c,* the structure and operation of a preferred embodiment of a panel holder of the subject invention will be described. A panel holder 10 is fabricated from an extruded plastic material and includes a first panel 12 having a first peripheral edge 14, a second peripheral edge 16 and a planar portion 18. Panel 12 is provided with a longitudinal C-shaped flange 20 attached to edge 14 and extending substantially along the full length thereof. Flange 20 includes an upper flange wall 22 connected to an outer flange wall 24 which then terminates in an inwardly projecting tongue 26. The enclosure formed by flange 20 and that portion of planar portion 18 adjacent to wall 22 and edge 14 defines a longitudinal chamber 28. Walls 22, 24 and tongue 26 are preferably integrally formed with panel 12, being extruded as one piece during fabrication. The end of tongue 26 is spaced apart from planar portion 18 thereby defining a longitudinal cleft 30 as illustrated in FIG. 2.

A second extruded panel 34 includes a first peripheral edge 36 and a second peripheral edge 38. Panel 34 is provided with a longitudinal C-shaped flange 40 attached to edge 36 extending substantially along the full length thereof. Flange 40 includes an inner wall 42, having an outer surface 43, an upper wall 44 and a lip 46 and encloses a groove 48. Panel 34 is provided with a pair of longitudinal ribs 50 integrally formed therewith and situated along peripheral edge 38. These ribs project inwardly towards the first panel portion 12. The second panel 34 extends in a plane arranged at a small acute angle to the first panel 12. The ribs extend inwardly from the second panel at a substantial angle thereto.

Figure 3A:
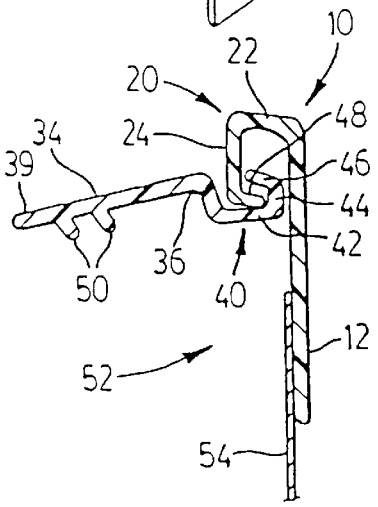
FIGS. 3*a*–3*c* illustrate three sectional views taken along lines 3—3 of FIG. 1 showing the panel holder in 3*a* the fully open position, 3*b* a partially closed position, and 3*c* the fully closed position.

Panel holder 10 is assembled by collinearly aligning tongue 26 with groove 48 as shown in FIG. 3*a* and sliding C-shaped flange 40 into longitudinal chamber 28 from an open end thereof. When fully assembled, flanges 20 and 40 form a longitudinal interlocking hinge connection about which panels 12 and 34 are movable in the transverse direction. FIG. 3*a* also represents a cross sectional view of poster holder 10 assembled and in the fully open position wherein tongue 26 and groove 48 form a longitudinal tongue-and-groove joint. In one aspect of the invention this tongue-and-groove joint acts to lock panel 34 in the open position. In this open position a receiving mouth 52 is formed between wall 44 and panel 12 for receiving a panel or poster 54 therebetween. The dimensions of flanges 20 and 40 are chosen to ensure that poster 54 can be readily and easily inserted into and removed from mouth 52, as will be discussed below.

Poster 54 could be any sheet material flexible or stiff. The width of tongue 26 and upper wall 44 can be varied to suit the thickness of the poster 54 to be retained in holder 10, as described further below. For the purposes of this specification, the term poster as used in reference to poster 54 is used interchangeably and is intended to include any sheet material, such as posters, pictures, plastic, paper or cloth sheet material, or the like.

Figure 3B:
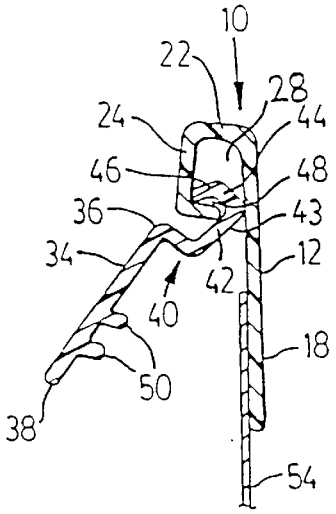
Figure 3C:
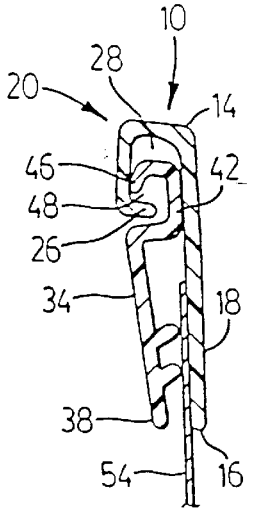
Figure 10B:
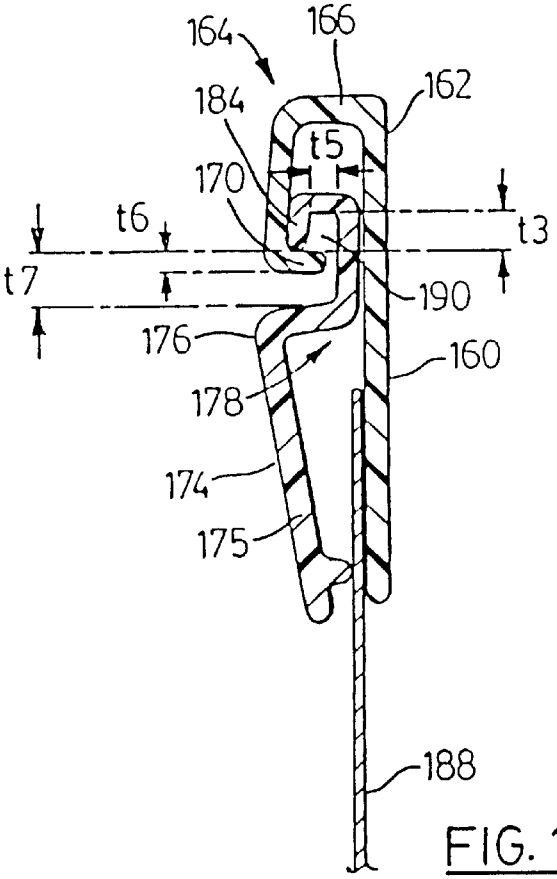
FIGS. 10*a* and 10*b* illustrate two sectional side views partly broken away of a panel holder according to the present invention showing the different dimensions to give the desired operation of the panel holder.
Figure 10A:
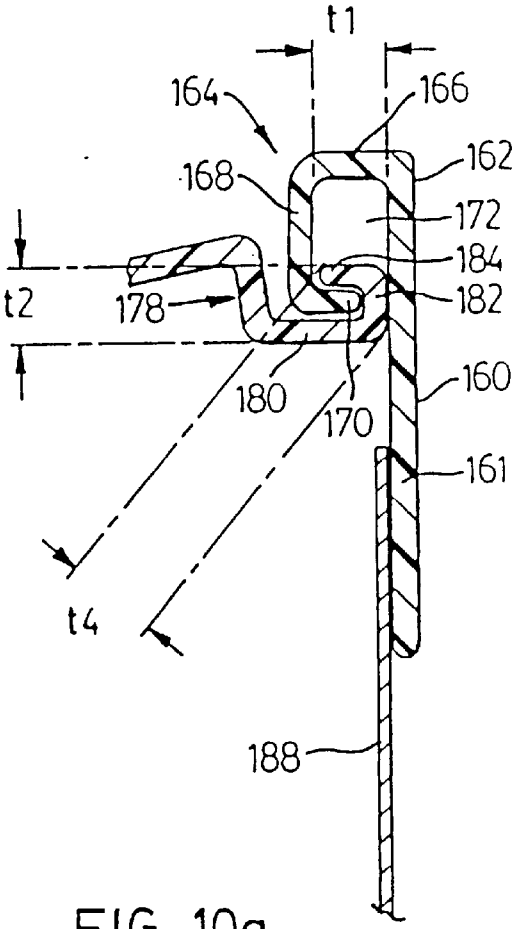

In operation, poster 54 is inserted into receiving mouth 52 and holder 10 is closed by rotating panel 34 with respect to and inwardly towards panel 12. The diagonal outer dimension of flange 40 being the distance between the outer extremity of the tip of lip 46 and the outer extremity of the joint between upper wall 44 and inner wall 42, which is designated as t4 in FIG. 10*a,* is desirably greater than the inner width of flange 20 with the result that as panel 34 is rotated flange 40 displaces wall 24 outwardly from planar portion 18. FIG. 3*b* shows poster holder 10 in the partially closed position corresponding to the maximum outward displacement of wall 24 relative to planar portion 18. The work done to initially rotate panel 34 towards portion 18 is stored as elastic potential energy in the flexible material making up walls 22 and 24, and once the point of maximum displacement is passed this potential energy is abruptly released thereby snapping panel 34 up against portion 18 in the closed position, see FIG. 3*c*. Ribs 50, which can be made of the same material as panel 34 or alternatively can be made of a softer more resilient material, exert an inward frictional force which acts to retard any downward movement of poster 54.

Panel holder 10 is particularly suitable for mounting a poster to be displayed on one side only. For standard rectangular posters four holders would have their corners mitred and the holders mounted on a backing panel, using for example two sided tape applied to the outer surface of panel 12 for adhesive bonding to the backing panel. The backing panel could then be adapted to be wall-mountable in one of several ways, for example using hooks or double sided tape.

Panel holder 10 is opened by gripping panel 34 along peripheral edge 38 and prying it apart from panel 12. The reverse of the closing procedure described above occurs wherein once panel 34 has been rotated past the point corresponding to the maximum outward displacement of wall 24, the latter snaps back toward portion 18 thereby rotating panel 34 to the open position. Poster 54 can then be removed and replaced as desired.

Figure 4B:
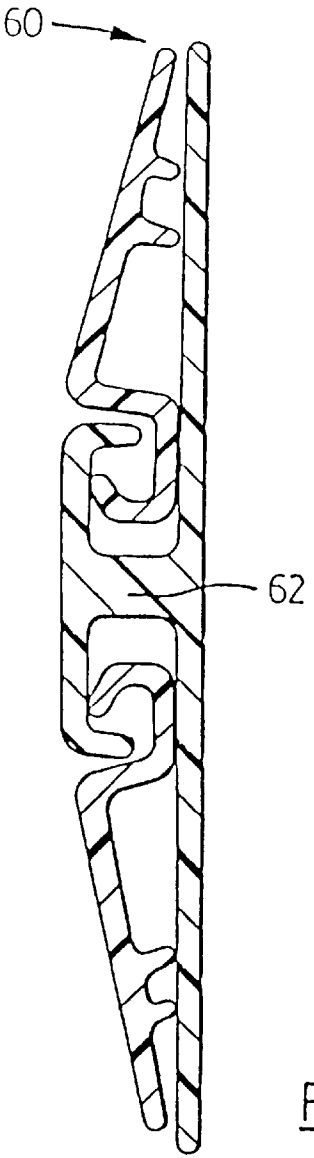
FIGS. 4*a*–4*b* illustrate two sectional views of an alternative embodiment of a panel holder of the present invention with 4*a* showing the fully open position and 4*b* the fully closed position.
Figure 4A:
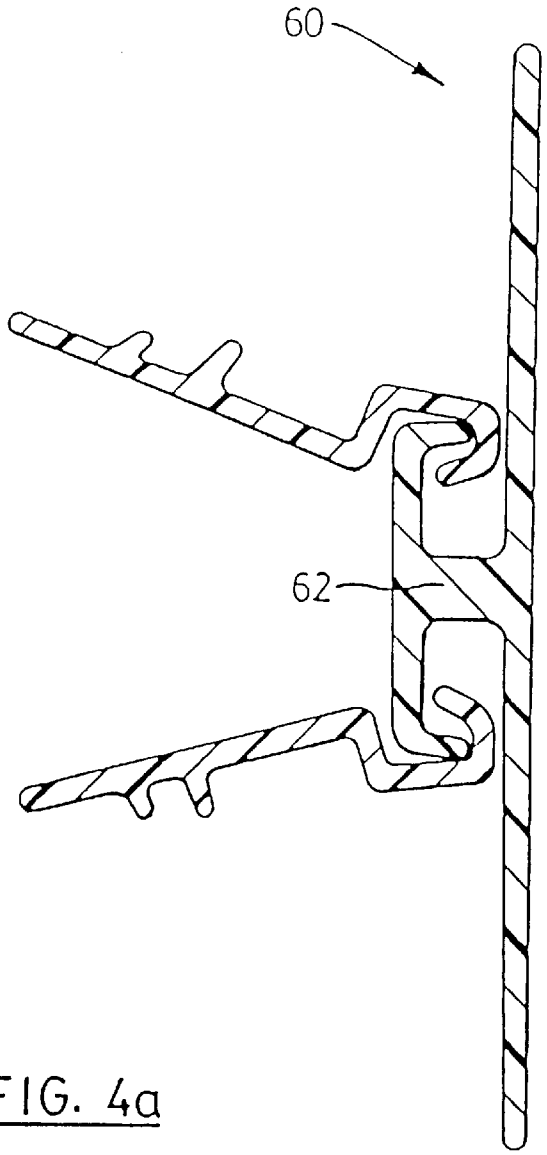
Figure 5:
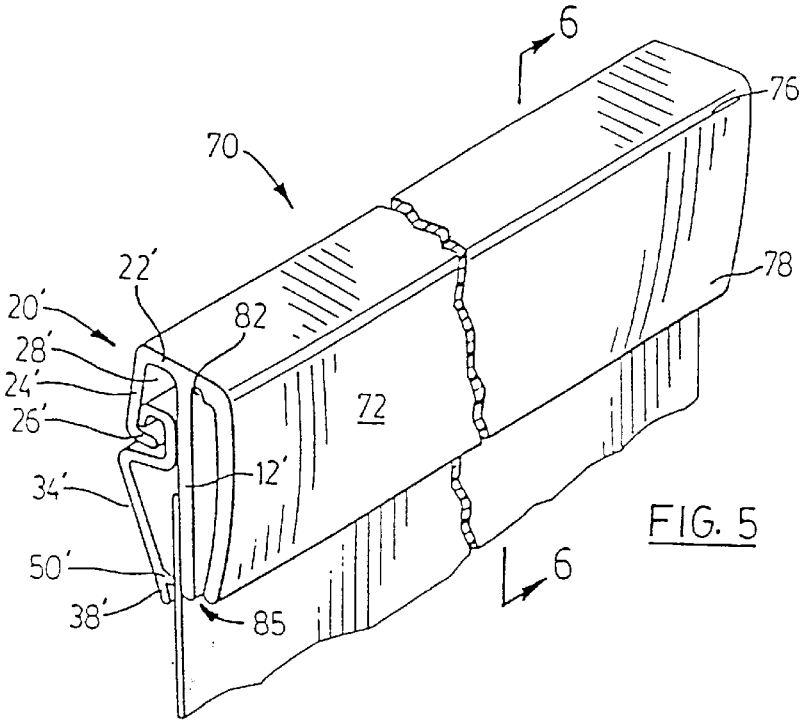
FIG. 5 is a perspective view of an alternative embodiment of a panel holder according to the present invention including a gripover frame.

FIGS. 4*a* and 4*b* illustrate another alternative embodiment of the panel holder of the subject invention wherein panel holder 60 comprises two panel holders 10 as illustrated in FIG. 1 integrally joined along a common wall 62. Such a holder would be useful for coupling multiple wall mounted posters or panels side by side or stacked one on top of the other as will be discussed below.

Referring to FIGS. 5 and 6*a*–6*c,* another embodiment of a panel holder is shown generally as 70. Panel holder 70 is similar to panel holder 10 shown in FIG. 1 but further comprises a gripover panel 72 for mounting holder 70 around the perimeter of a mounting board 74 (see FIG. 6*a*). Gripover panel 72 includes a first peripheral edge 76 and a second peripheral edge 78. Panels 12' and 72 are joined along their respective first peripheral edges 76 and 14', preferably being co-extruded at the time of fabrication.

Gripover panel 72 has an inwardly arcuate shape and is provided with a reinforced longitudinal corner section 80 situated along the inner portion of peripheral edge 76 to strengthen the connection of gripover panel 72 to panel 12'. Reinforced section 80 is desirable as section 80 will be a region of maximum stress when holder 70 is being placed on or being removed from mounting hardboard 74. Gripover panel 72 is provided with a slot 82 situated between section 80 and peripheral edge 14' for receiving the top edge 83 of board 74. Peripheral edges 14' and 76 of panels 12' and 72 respectively form a receiving mouth 85 (see FIG. 6*b*) for board 74. Panel 72 is resilient such that holder 70 grips board 74 when mounted thereon.

Figure 6A:
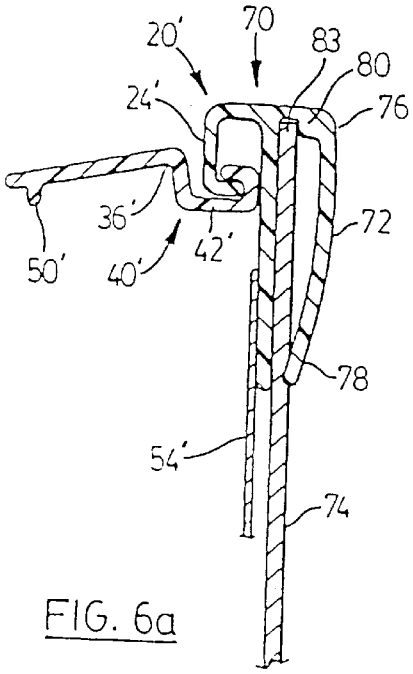
FIGS. 6*a*–6*c* are sectional views taken along the line 6—6 of FIG. 5 showing in FIG. 6*a* the poster holder in a fully open position, in FIG. 6*b* in a partially closed position, and in FIG. 6*c* in a fully closed position.
Figure 6B:
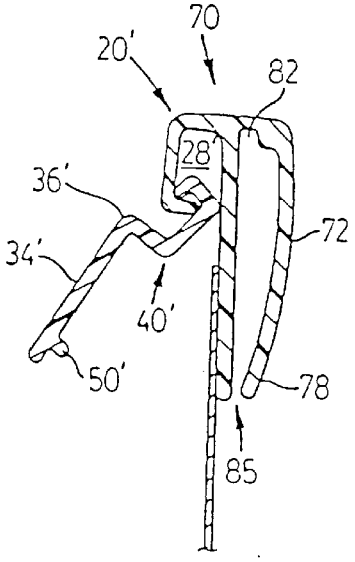
Figure 6C:
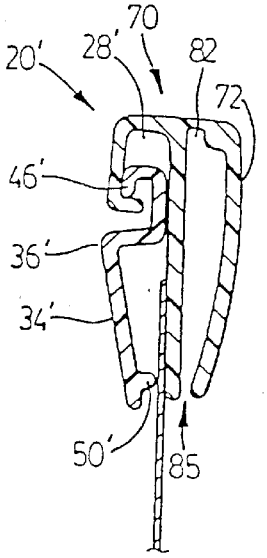
Figure 7:
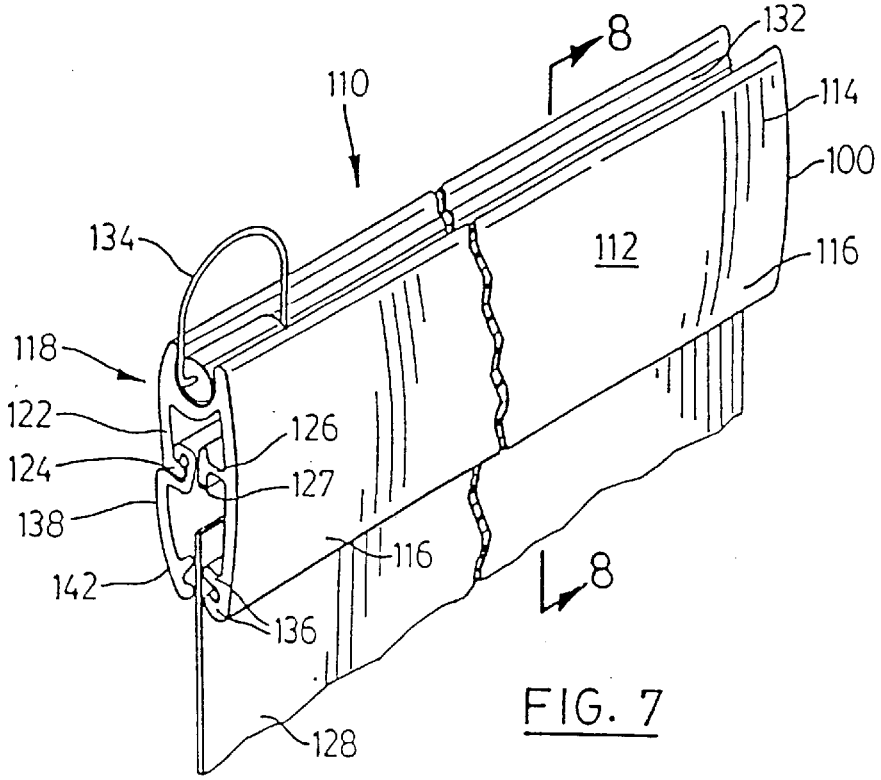
FIG. 7 is a perspective view of another embodiment of a panel holder according to the present invention including poster holder hangers.
Figure 8A:
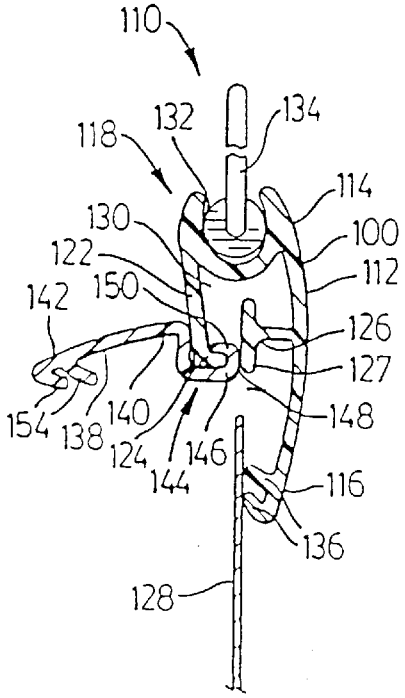
FIGS. 8*a*–8*c* are sectional views taken along the lines 8—8 of FIG. 7 showing in FIG. 8*a* the panel holder in the fully open position, in FIG. 8*b* a partially closed position, and in FIG. 8*c* the fully closed position.
Figure 8B:
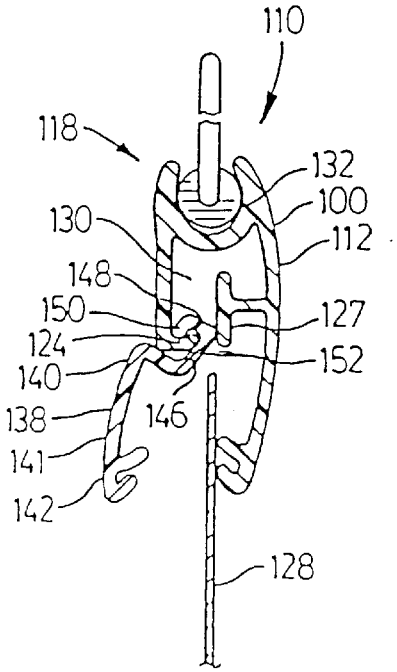
Figure 8C:
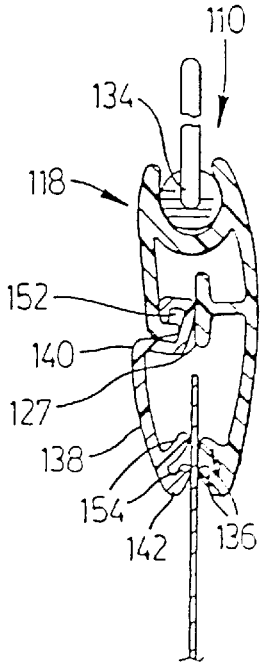
Figure 9B:
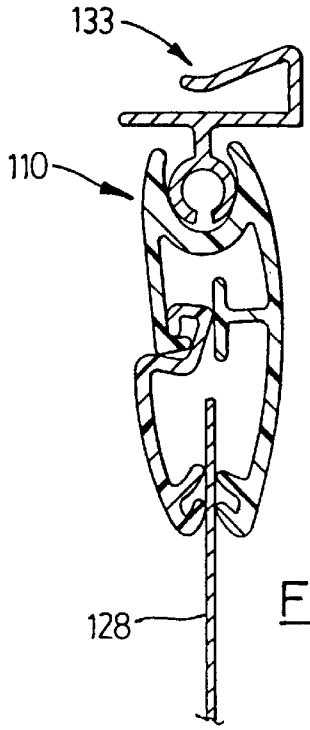
FIG. 9*b* is a cross-sectional view along the line 9—9 of FIG. 9*a* in a fully closed position.
Figure 11A:
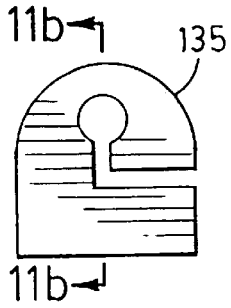
Figure 11B:
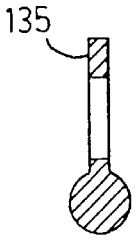
* and FIG. 11*b* is a cross-sectional view of the embodiment of a cylindrical hanger unit along the line 11*b*—11*b* in FIG. 11*a*.
Figure 9A:
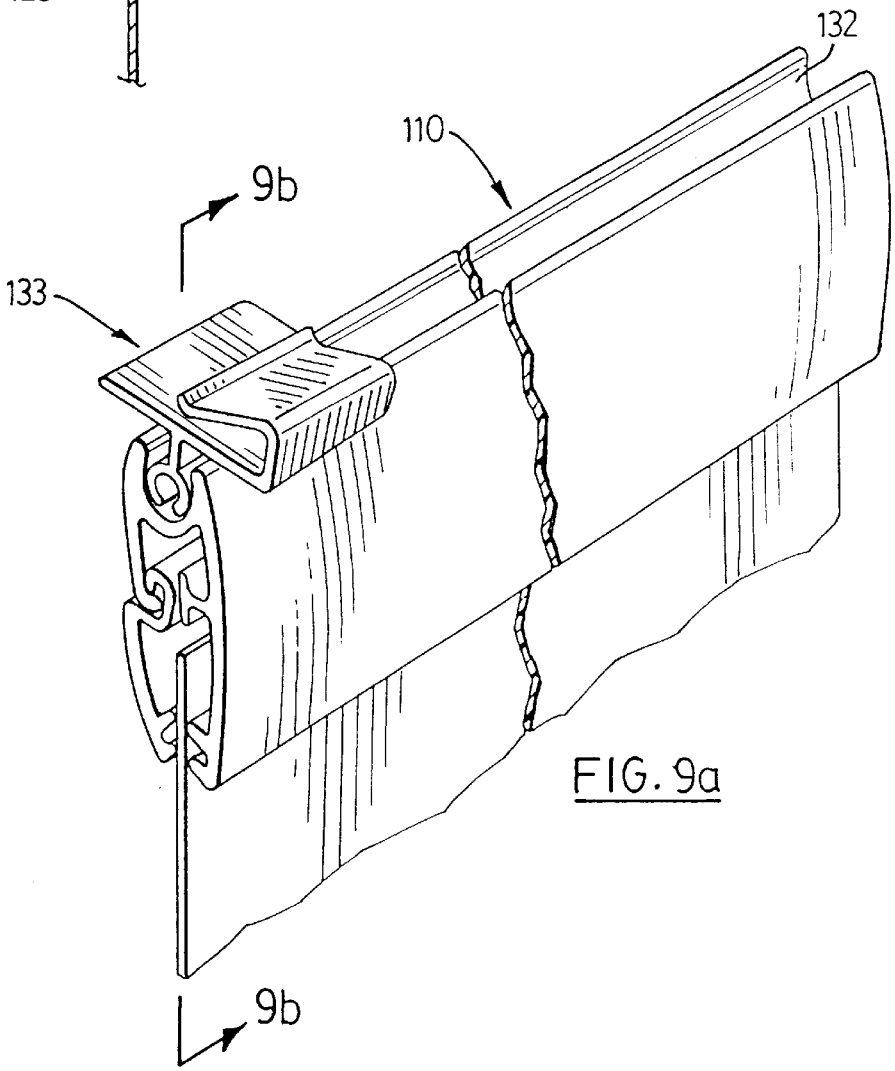
FIG. 9*a* is a perspective view of an alternative embodiment of a panel holder according to the present invention including a cylindrical clip unit.

The assembly and operation of panel holder 70 is identical to that disclosed for panel holder 10 illustrated in FIG. 1 and FIGS. 3*a*–3*c*. FIGS. 6*a* to 6*c* show holder 70 in the open, partially closed and closed positions respectively. It will be understood that the full perimeter of a rectangular poster can be secured by panel holder 70 by mitring the corners of the latter. Alternatively, the corners may be cut to any angle depending on the geometric shape of the sheet material to be retained by holder 70.

Referring now to FIGS. 7 and 8*a*–8*c*, yet another embodiment of a panel holder is shown at 110 and includes an extruded plastic, longitudinal member 100 having an arcuately shaped first panel 112 having a first peripheral edge 114 and a second peripheral edge 116. Panel 112 is provided with a generally C-shaped longitudinal flange 118 extending along peripheral edge 114. Flange 118 is formed with an upwardly opening longitudinal channel 132 joined to an outer wall 122 which terminates in an inwardly projecting tongue 124. Panel 112 is also provided with an inwardly projecting longitudinal rib 126 having a transverse planar portion 127 positioned adjacent to and generally parallel to outer wall 122. Flange 118 and rib 126 enclose a longitudinal chamber 130. Longitudinal cylindrical chamber 132 extends substantially along the full length of panel 112. Holder 110 is provided with a plurality of cylindrical hanger units 134 adapted to be slidably inserted into chamber 132 from the ends of panel 112. Panel 112 is provided with a pair of longitudinal, resiliently soft arcuate ribs 136 spaced from first longitudinal peripheral edge 114 and situated along the inner portion of peripheral edge 116. The peripheral edge 116 with its soft ribs 136 comprises a first contact portion for contacting and engaging one side of poster 128 as explained further below.

A second inwardly arcuately shaped panel 138 comprises a first peripheral edge 140, a central panel portion 141 and a second peripheral edge 142. Panel 138 is provided with a generally C-shaped flange 144 extending along substantially the full length of edge 140. The perimeter of flange 144 includes an inner wall portion 146 connected to an upper wall 148 which in turn terminates in a peripheral lip 150. Flange 144 encloses a longitudinal groove 152 therein which extends along the length of panel 138. Panel 138 is provided with a pair of longitudinal, parallel, resiliently soft arcuate ribs 154 spaced from first longitudinal peripheral edge 140 and situated along peripheral edge 142 and adapted to be in registration and engaged with ribs 136 when holder 110 is in the closed position, (see FIG. 8*c*). The second peripheral edge 142 with its soft ribs 154 comprises a second contact portion for contacting and engaging an opposite side of the poster 128. Thus, in the closed position, the ribs 136, 154 together engage and retain a poster 128 or other sheet material therebetween.

The operation of holder 110 is essentially identical to that of panel holder 10 illustrated in FIG. 1 with the following differences. Ribs 136 and 154, being fabricated of a soft and resilient material, exert an inward frictional force which resists the downward motion of poster 128 when holder 110 is fully closed. Since holder 110 is specifically adapted for hanging or suspending posters or other sheet material, it can be used along the upper edge of a poster in conjunction with, for example, poster holder 10 as illustrated in FIG. 1 clamped around the remaining perimeter of the poster.

In one application it may be desirable to mount several posters or panels side by side or one stacked longitudinally on top of another. To do this, panel holder 110 illustrated in FIG. 7 may be utilized along the top edge of the poster while poster holder 60 illustrated in FIG. 4 may be employed around the remaining perimeter of the poster. This is particularly suitable for poster combinations requiring multiple posters wherein one poster is anticipated to be present for a longer period of time while the associated posters must be changed periodically.

Referring now to FIGS. 9*a*, 9*b*, 11*a* and 11*b*, an alternative embodiment of a panel holder according to the present invention is depicted in which a variety of different cylindrical hanger units 133 and 135 are utilized. It will be appreciated that a great variety of cylindrical hanger units may be used without departing from the present invention.

Referring again to FIGS. 1, 3*a*, 3*b*, 3*c*, 10*a* and 10*b*, it will be appreciated that one notable aspect of the subject invention relates to the abrupt release of elastic potential energy stored in walls 22 and 24 which imparts a substantial impulse to panel 34 which will result in it "snapping" up against planar portion 18 thus compressing poster 54 therebetween. It will also be understood that the magnitude of this elastic potential energy created and hence the quality of the snapping action will be determined in part by the elastic properties of walls 22 and 24 which in turn can be tailored by co-extruding panel 12 and flange 20 using materials with optimized elastic properties for walls 22 and 24 if so desired.

In another aspect of the invention, interlocked panels 12 and 34 cooperate to produce a cam actuated to position clamp. The cam actuated clamping action occurs as panel 34 is rotated inwardly towards panel 12 wherein the rotational motion of flange 40 confined in chamber 28 acts to displace wall 24 outwards. Thus, flange 40 performs the role of the cam while the longitudinal hinge connection corresponds to the cam axis and wall 24 corresponds to the cam follower. The work done to displace wall 26 from its equilibrium position is converted into and stored as elastic potential energy in walls 22 and 24 which in turn is released as panel 34 passes the point corresponding to the maximum outward displacement of wall 24 and is utilized to create a compressive force biasing panel 34 against panel 12 in the fully closed position.

The formation of the well defined receiving mouth and the tongue-and-groove joint in the open position and the snapping action during opening and closing are predicated on the two flanges having the appropriate dimensions. These dimensions are discussed with reference to FIGS. 10*a* and 10*b* wherein a panel 160 has a first peripheral edge 162 and is provided with a longitudinal C-shaped flange 164 attached along edge 162. Flange 164 is resilient and includes an upper wall 166 attached to an outer wall 168 which in turn terminates in an inwardly pointing tongue 170. Flange 164 and that portion of panel 160 adjacent to flange 164 enclose a longitudinal chamber 172. Chamber 172 has an internal equilibrium cross sectional dimension of t1 which is a first predetermined distance that wall 168 is spaced from planar portion 161.

A second panel 174 is provided having a planar portion 175 and a first peripheral edge 176 and includes a longitudinal C-shaped flange 178 attached along edge 176. Flange 178 comprises an inner wall portion 180 joined to an upper wall 182 which terminates in a peripheral lip 184. Flange 178 has an equilibrium cross sectional dimension of t2 which is a second predetermined distance and is greater than t1. The dimension t2 is chosen to be slightly greater than t1 so that wall 168 will be displaced outwardly a small distance from its equilibrium dimension when panel 174 is closed. This outward displacement of flexible wall 168 acts to apply a compressive force thereby resiliently biasing panel 174 in the closed position, see FIG. 10*b*. Lip 184 extends transversely from inner wall portion 182 towards planar portion 175 a third predetermined distance t3, wherein t3 is less than t1 so that in the open position a gap forms of sufficient dimension to receive a poster 188 therein.

Flange 178 has an outer diagonal dimension t4 which is greater than t1, so that during opening and closing of the holder, flange 178 translationally displaces wall 168 outward a distance sufficient to build up the necessary elastic potential energy required to produce the snapping action when wall 168 passes the point of maximum outward displacement. Flange 178 encloses a groove 190 which has an inner width t5 while the width of tongue 170 is t6, wherein t6 is less than or approximately equal to dimension t5 as will be discussed below. The dimension t7 is the distance between the end of lip 184 and peripheral edge 176.

The distance that panel 174 swings open is determined by the three dimensions t5, t6 and t7. In one limit for t5, t6 and t7, panel 174 will swing open a fixed distance and remain locked relatively firmly in the open position since tongue 170 and groove 190 form a tight tongue-and-groove joint. Poster holder 110 illustrated in FIGS. 7 and 8 closely approaches this limit. This particular situation is preferable for two reasons: first, the frictional forces arising between the two flanges due to their snug fit will ensure little or no lateral movement between the two panels whereas for t6<t5, a loose fit will result and hence the panels may slide apart if the assembled poster holder is inclined from the horizontal while in the open position. Secondly, the gap which forms the receiving mouth between flange 178 and panel 160 in the open position is fixed since tongue 170 cannot slide in groove 190 in the locked open position. Dimension t3 is also chosen to ensure that tongue 170 remains firmly interlaced with groove 190 in the open position thereby forming a tight tongue-and-groove joint.

The two panels are preferably extruded from a rigidly resilient plastic material such as polyvinyl chloride (PVC). The ribs can be fabricated from either the same PVC material or alternatively they can be made from a softer more resilient grade of PVC having a higher coefficient of friction. Alternatively, the panels and associated ribs could be fabricated from an extruded metal having the appropriate elastic properties, an example being aluminum.

Another notable feature of some of the preferred embodiments of the panel holder of the present invention is the existence of two pressure points acting on a poster; this differential clamping action being advantageous in increasing the retaining power of the holder. As a representative example of this, reconsider FIG. 3*c* wherein panel holder 10 compresses poster 54 at two points, the first being between planar portion 18 and wall 42 and the other two points being planar portion 18 and ribs 50.

While the present invention has been described and illustrated with respect to the preferred embodiments, it will be appreciated that numerous variations of these embodiments may be made without departing from the scope of the invention, which is defined in the appended claims.

What I claim is:

1. A panel holder comprising:

(a) a first elongate panel made from extruded plastic and provided with a first planar portion and a longitudinal generally C-shaped flange located along a first peripheral edge thereof and integrally formed with said first elongate panel;

(b) a second elongate, plastic panel having a main portion with a longitudinal rib member formed thereon and located near a peripheral edge of said second panel spaced from said C-shaped flange, said rib member being co-extruded with the second elongate panel, being located on a side of said second panel facing said first planar portion when said second panel is in a closed, panel-gripping position and being made of a softer, more resilient material than the rest of the second panel;

(c) means for pivotably connecting said second elongate panel to said C-shaped flange so that said second panel can be pivoted from said closed position to an open position; and (d) means for releasably holding said second panel in said closed position.

2. A panel holder according to claim 1 wherein a second longitudinal rib member is formed on said second elongate panel, the two rib members both being located on said side of said second panel facing said first planar portion and both being made of a softer, more resilient material than the rest of the second panel.

3. A panel holder according to claim 1 wherein said first panel is extruded from flexible plastic.

4. A panel holder according to claim 1 wherein said C-shaped flange is resilient such that it is elastically deformable during pivoting of said second panel between said closed and open positions.

5. A panel holder according to claim 1 wherein said first elongate panel has at least one longitudinal rib member formed on said first planar portion and located near a peripheral edge of said first panel spaced from said C-shaped flange, said at least one rib member being located on a side of said first planar portion facing said second panel and being made of a softer, more resilient material than the rest of the first panel.

6. A panel holder according to claim 5 wherein said at least one rib member on the first panel is co-extruded with the first elongate panel.

7. A panel holder according to claim 5 wherein both said first panel and said second panel are extruded from flexible plastic.

8. A panel holder according to claim 1 wherein said first elongate panel has two parallel, longitudinal rib members formed on said first planar portion and located near a peripheral edge of said first panel spaced from said C-shaped flange, said two rib members being located on a side of said first planar portion facing said second panel and both being made of a softer, more resilient material than the rest of said first panel.

9. A panel holder, comprising:

(a) an elongate first plastic member provided with a first panel having an inwardly projecting longitudinal rib with a transverse planar portion, a first longitudinal, generally C-shaped flange located along a first peripheral edge thereof and having an inturned tongue extending towards and spaced from said rib planar portion;

(b) an elongate second plastic panel provided with a second panel portion and a second longitudinal C-shaped flange located along a first peripheral edge thereof, the second flange being slidably received within the first flange and said second panel being pivotable relative to said first member between an open position and a closed, panel-gripping position; and (c) at least one, longitudinal rib formed on one of said first and second panels by co-extrusion with the first or second panel and located along a peripheral edge thereof spaced from said C-shaped flanges, said at least one longitudinal rib being located on a side of its respective panel facing the other of said panels in the closed position of the second panel and being made of a softer, more resilient material than its respective panel.

10. A panel holder according to claim 9 wherein a second, co-extruded longitudinal rib is formed on the other of said first and second panels and is located on a peripheral edge of its respective panel spaced from said C-shaped flanges and the longitudinal ribs are all made of a softer, more resilient material than their respective panels.

11. A panel holder comprising a first elongate member having a first elongate panel portion with first and second longitudinal peripheral edges, a second elongate member having a second panel portion and pivotable with respect to said first member, means for pivotably connecting said second member to said first member along said first peripheral edge so that the two elongate members can pivot between an open position and a closed, panel-gripping position, and a co-extruded longitudinal rib formed on said second panel portion and located adjacent a peripheral edge thereof spaced from said first peripheral edge, said rib being located on a side of said second panel portion facing said first panel portion in said closed position and being made of a softer, more resilient material than the second elongate member.

12. A panel holder according to claim 11 wherein a second, co-extruded longitudinal rib is formed on said second panel portion and is located adjacent said peripheral edge thereof, the two ribs being located on the same side of said second panel portion and both being made of a softer, more resilient material than the second elongate member.

13. A panel holder according to claim 12 wherein said ribs are made of PVC material.

14. A panel holder according to claim 12 wherein said second panel portion extends in a plane at a first acute angle to said first elongate panel portion when the first and second elongate members are in the closed, panel-gripping position, and said ribs extend inwardly from said second panel portion at a second arcuate angle thereto, said second acute angle being greater than said first acute angle.

* * * * *